US010328473B2

(12) United States Patent
Angelilli et al.

(10) Patent No.: US 10,328,473 B2
(45) Date of Patent: Jun. 25, 2019

(54) DRAWING MACHINE FOR DRAWING TUBES

(71) Applicant: Danieli & C. Officine Meccaniche S.P.A., Buttrio (IT)

(72) Inventors: Andrea Angelilli, Pacentro (IT); Luca Crespan, Cervignano Del Friuli (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 161 days.

(21) Appl. No.: 14/787,449

(22) PCT Filed: Nov. 20, 2014

(86) PCT No.: PCT/IB2014/066193
§ 371 (c)(1),
(2) Date: Oct. 27, 2015

(87) PCT Pub. No.: WO2015/075660
PCT Pub. Date: May 28, 2015

(65) Prior Publication Data

US 2016/0279689 A1 Sep. 29, 2016

(30) Foreign Application Priority Data

Nov. 20, 2013 (IT) ..... MI2013A1926

(51) Int. Cl.
*B21C 51/00* (2006.01)
*B21C 3/14* (2006.01)
*B21C 1/24* (2006.01)

(52) U.S. Cl.
CPC ..... *B21C 51/00* (2013.01); *B21C 1/24* (2013.01); *B21C 3/14* (2013.01)

(58) Field of Classification Search
CPC .. B21C 1/16; B21C 1/24; B21C 23/12; B21C 25/02; B21C 3/16; B21C 37/06; B21C 37/15
See application file for complete search history.

(56) References Cited

U.S. PATENT DOCUMENTS 4,196,607 A * 4/1980 Youtsey ..... B21C 1/24 72/31.06
4,545,227 A 10/1985 Sudoh et al.
(Continued)

FOREIGN PATENT DOCUMENTS

DE 2912996 10/1979
DE 19711028 9/1998
(Continued)

OTHER PUBLICATIONS

EPO Machine Translation of EP 1022070 A2, May 2018.*

*Primary Examiner* — Pradeep C Battula
(74) *Attorney, Agent, or Firm* — Stetina Brunda Garred & Brucker

(57) ABSTRACT

A drawing machine (1) for drawing a tube (2), defining a longitudinal axis (Y), comprising a first die (3) for carrying out the drawing of the tube by means of the use of a mandrel (4); a device for varying the inclination (5) of the tube inlet into said first die (3); a second die (6) for carrying out a skin pass operation on the tube, arranged downstream of said first die (3); an in-line system for detecting the eccentricity of the tube; a data processing system (7) for processing signals originating from said detection system and sending input data to said device for varying the inclination (5) of the tube to vary the inclination of the tube so as to correct the eccentricity of the tube in-line; wherein said in-line system for detecting the eccentricity of the tube comprises a first
(Continued)

detection head comprising at least three first transducers (8) arranged downstream of said first die (3).

20 Claims, 6 Drawing Sheets

(56) References Cited

U.S. PATENT DOCUMENTS

| | | | | |
|---|---|---|---|---|
| 6,470,723 | B2 * | 10/2002 | Sumitomo | B21C 1/24 72/283 |
| 6,715,331 | B1 * | 4/2004 | Zelin | B21C 1/04 72/278 |
| 6,823,706 | B1 | 11/2004 | Kaneko et al. | |
| 2003/0015511 | A1 | 1/2003 | Kim et al. | |
| 2005/0019496 | A1 | 1/2005 | Yoshida et al. | |
| 2005/0044687 | A1 | 3/2005 | Matsuguchi et al. | |
| 2005/0087270 | A1 | 4/2005 | Nagao et al. | |
| 2010/0064750 | A1 | 3/2010 | Corder | |
| 2014/0295206 | A1 | 10/2014 | Aoya et al. | |

FOREIGN PATENT DOCUMENTS

| | | | | |
|---|---|---|---|---|
| EP | 1022070 | A2 * | 7/2000 | B21C 1/24 |
| JP | S58135718 | | 8/1983 | |
| JP | S62212012 | | 9/1987 | |

* cited by examiner

DRAWING MACHINE FOR DRAWING TUBES

CROSS REFERENCE TO RELATED APPLICATIONS

The present application claims priority to PCT International Application No. PCT/IB2014/066193 filed on Nov. 20, 2014, which application claims priority to Italian Patent Application No. M12013A001926 filed Nov. 20, 2013, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a drawing machine for drawing tubes provided with an in-line system for detecting the eccentricity of the tube and means for adjusting said eccentricity.

STATE OF THE ART

Various drawing machines for drawing tubes are known, for example copper tubes, which are provided with an in-line eccentricity detection system and with means for adjusting said eccentricity.

An example of these machines, which is illustrated in document US2010/064750A1, provides the use of transducers on the die holder of the working die, that is the die that carries out the drawing of the tube by means of the use of a mandrel. A data processing system processes the signals originating from said transducers and sends processed/filtered data to a mechanical system for adjusting the inlet angle of the tube into the working die.

The operation of the system is the following: during the drawing, the tube is measured continuously by the transducers arranged in the working die; the "n" thicknesses detected for each portion of tube surface are sent to a PLC which, by processing them by using an algorithm thereof causes the mechanical system constrained to the tube to move, thus varying the inlet angle of the tube into the working die. As the rotation fulcrum is the working die itself, this action causes a suitable variation in the die-mandrel coupling thus attempting to zero the dimensional variations of the "n" thicknesses.

Since the temperature of the working die during the drawing stabilizes at around 350-370° C., and the tube temperature stabilizes at around 80-90° C., these temperatures quickly ruin the transducers, which therefore have a reduced life.

Thus, the need is felt to make a drawing machine for drawing tubes which allows overcoming the aforesaid drawbacks.

SUMMARY OF THE INVENTION

It is the main object of the present invention to make a drawing machine for drawing tubes which allows the eccentricity of the tube to be detected and corrected in-line, with increased reliability and accuracy over time with respect to known machines.

A further object of the invention is to realize a related in-line method for correcting the eccentricity of a tube during the drawing thereof, by means of the use of said drawing machine.

Thus the present invention proposes to achieve the objects discussed above by making a drawing machine for drawing tubes, defining a longitudinal axis Y, which, in accordance with claim 1, comprises:

a first die for carrying out the drawing of the tube by means of the use of a mandrel;

a device for varying the inclination of the tube entering said first die;

an in-line detection system for detecting the eccentricity of the tube;

a data processing system for processing signals originating torn said detection system, and sending input data to said device for varying the inclination of the tube to vary the inclination of the tube so as to correct the eccentricity of the tube in-line;

characterized in that there is provided a second die for carrying out a skin pass operation, on the tube, which is arranged downstream, of said first die, and in that said in-line detection system for detecting the eccentricity of the tube comprises a first detection head arranged downstream of said first die and comprising at least three first transducers.

According to a further aspect of the invention, there is provided an in-line method for correcting the eccentricity of a tube during the drawing thereof, by means of the use of a drawing machine, which, in accordance with claim 10, comprises the following stages:

drawing the tube by means of the first die;

carrying out a skin pass operation on the tube by means of the second die:

carrying out a first in-line detection of the eccentricity of the tube by means of the first detection head;

processing the signals originating from said first detection head by means of the data processing system and sending input data to the device for varying the inclination of the tube so as to vary the inclination of the tube with respect to the longitudinal axis Y and to correct, the eccentricity of the tube in-line.

The drawing machine object of the present invention allows the tube to recover part of the eccentricity thereof during the caterpillar drawing, with a reduction of at least 2-4 percentage points. For example, the system brings the eccentricity from 6% at inlet to 2% at outlet.

The operating principle of the heads for detecting the thickness of the tube, and therefore the eccentricity thereof, provided with ultrasonic transducers, is based on the fact that sound propagates in bodies by means of the elastic vibration of the atoms and the molecules that accompany the bodies at a speed dependent on the mechanical features of the material crossed (for example: steel V=5900 m/s, copper V=4700 m/s). The presence of imperfections or non-uniformity in the body causes the occurrence of scattering phenomena, which generally occur with an attenuation of the sound wave. The ultrasonic start signal (start echo) and the one reflected by the separation surface of two different materials (Intermediate echo) are displayed on a screen as peaks which distance is proportional to the time used by the ultrasounds to travel towards and from the probe or transducer to the opposite reflecting surface. Unlike light, acoustic waves require an elastic medium to propagate therein; this explains why sound does not propagate in vacuum. For such a reason, the ends of the transducers of the second skin pass die are in contact with a channel in which there is provided a coupling medium, such as oil.

The machine of the invention allows approximately 5000-15000 scans per second to be performed, which is equivalent to approximately 2-6 acquisitions per millimeter of tube. In a first variant of the invention, the first detection head is arranged in a die holder of the second die.

In a second variant of the invention, the first detection head is arranged in a chamber, which is coaxial to the longitudinal axis Y and is provided between a die holder of the first die and the die holder of the second die.

In a third variant of the invention, there are instead two first detection heads: the first in the die holder of the second die and the second in the aforesaid chamber.

In all three variants of the invention, there can be provided a second detection head downstream of the skin pass die to check whether the correction system is actually recovering or generating eccentricity.

The dependent claims describe preferred embodiments of the invention.

BRIEF DESCRIPTION OF THE FIGURES

Further features and advantages of the invention will be more apparent in light of the detailed description of preferred, but not exclusive, embodiments of a drawing machine for drawing tubes, disclosed by way of a non-limiting example, with the aid of enclosed drawings in which.

The same reference numerals in the drawings identify the same elements or components.

DETAILED DESCRIPTION OF PREFERRED EMBODIMENTS OF THE INVENTION

Figure 1:
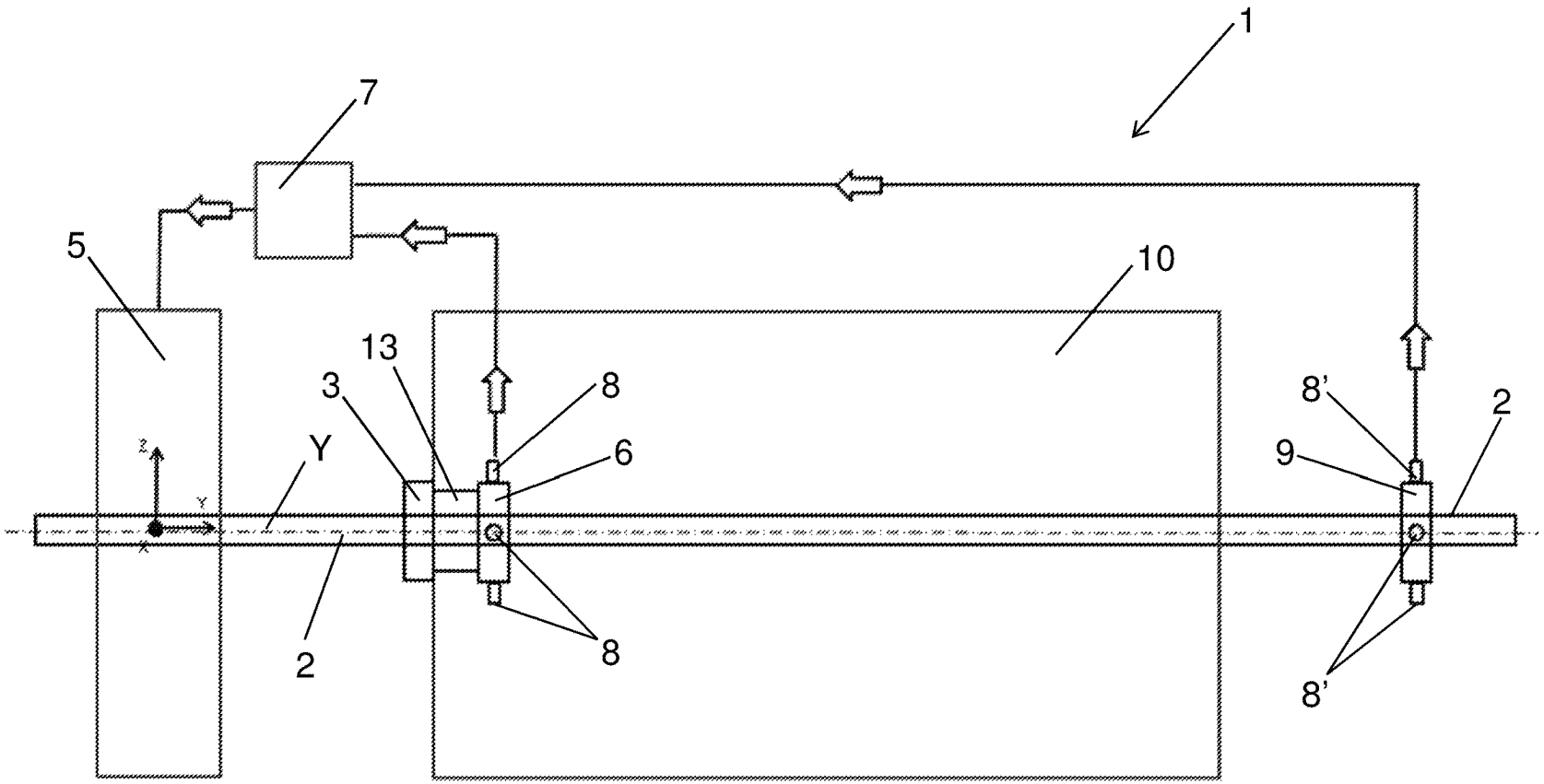
FIG. 1 shows a schematic view of an embodiment of the machine of the invention.
Figure 2:
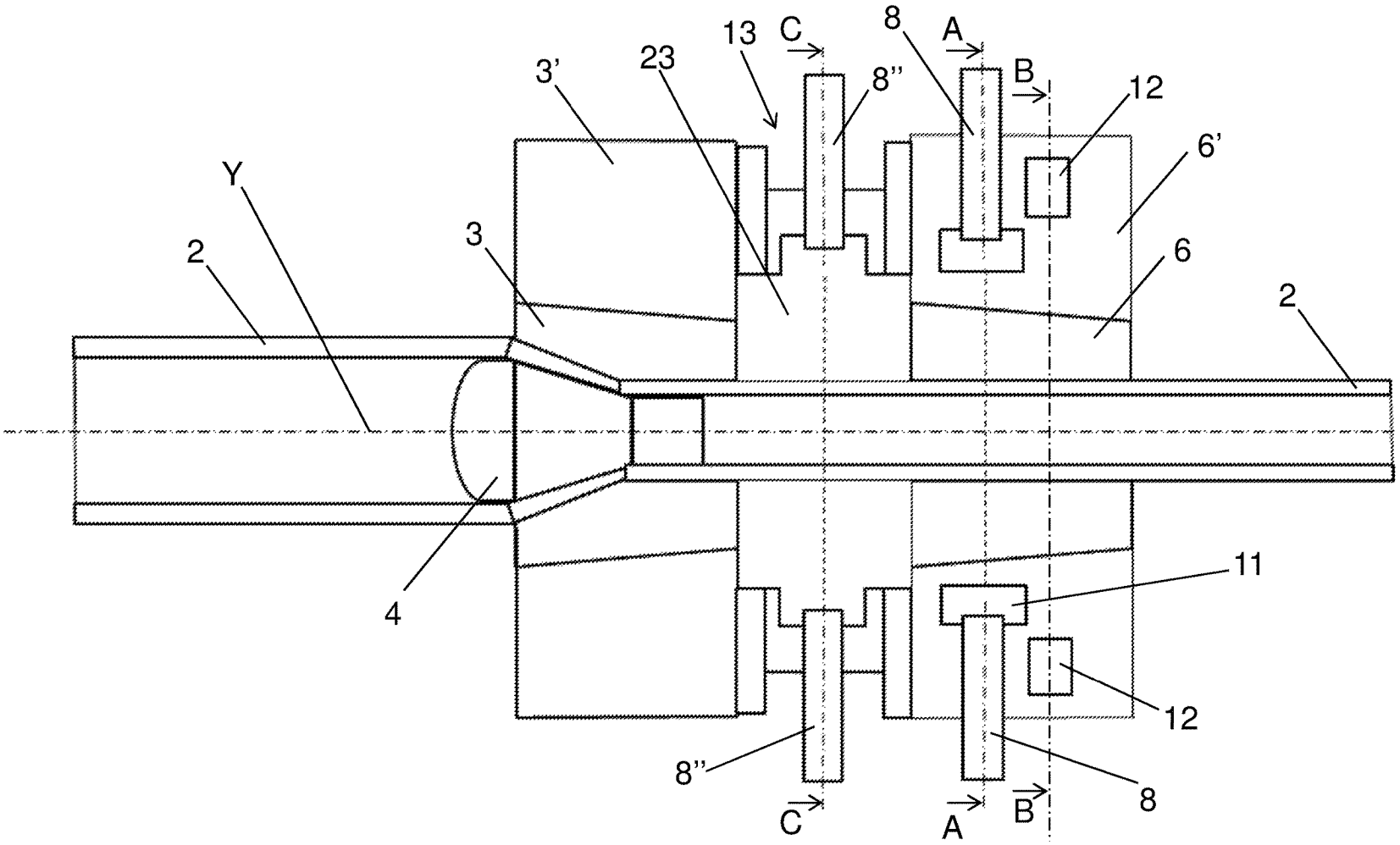
FIG. 2 shows a schematic sectional side view of a first part of the machine in FIG. 1.
Figures 2A, 2B:
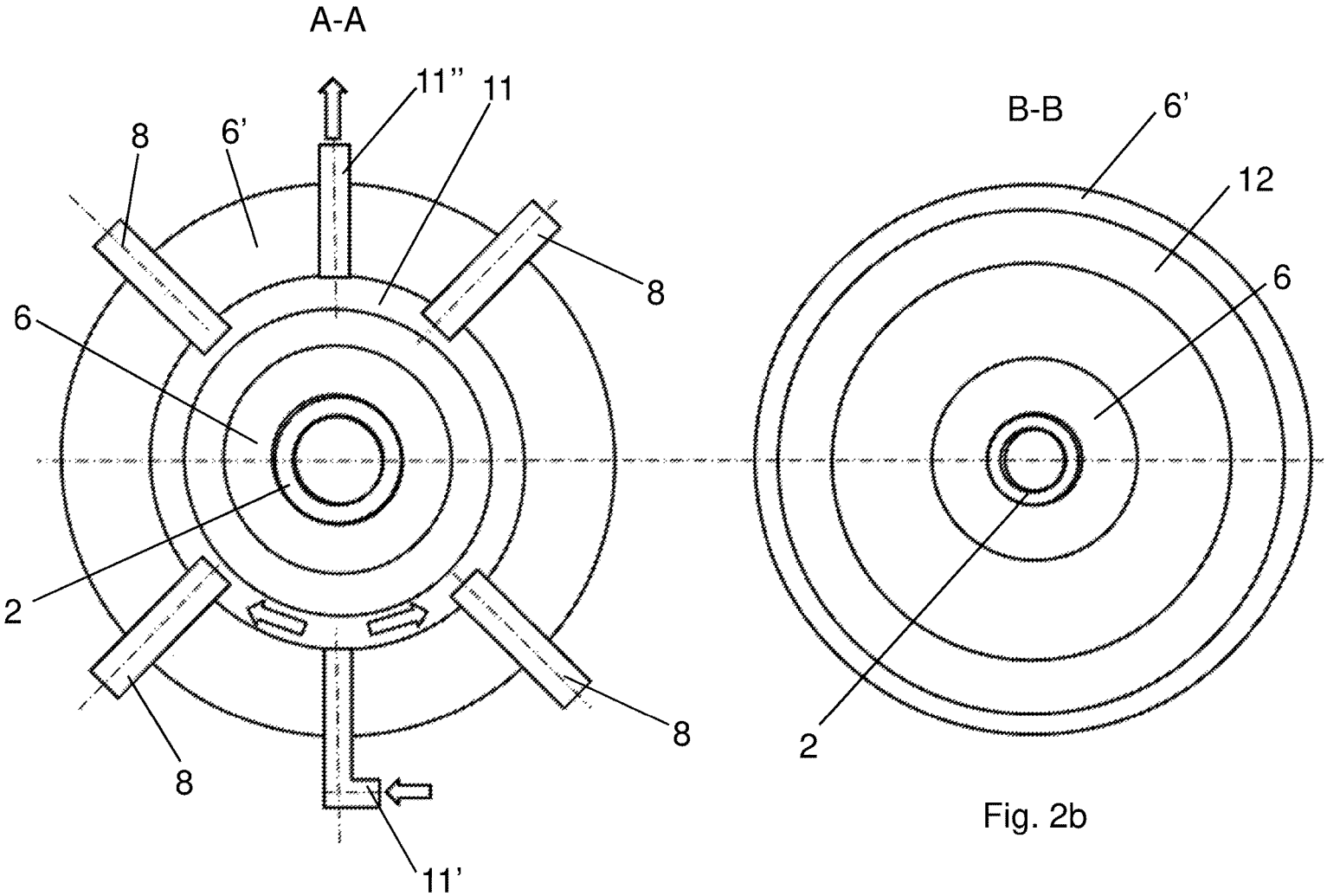
FIGS. 2*a*, 2*b* and 2*c* show sectional, views, along a plane A-A, along a plane B-B and along a plane C-C, respectively, of said first part of the machine in FIG. 2.
Figure 2C:
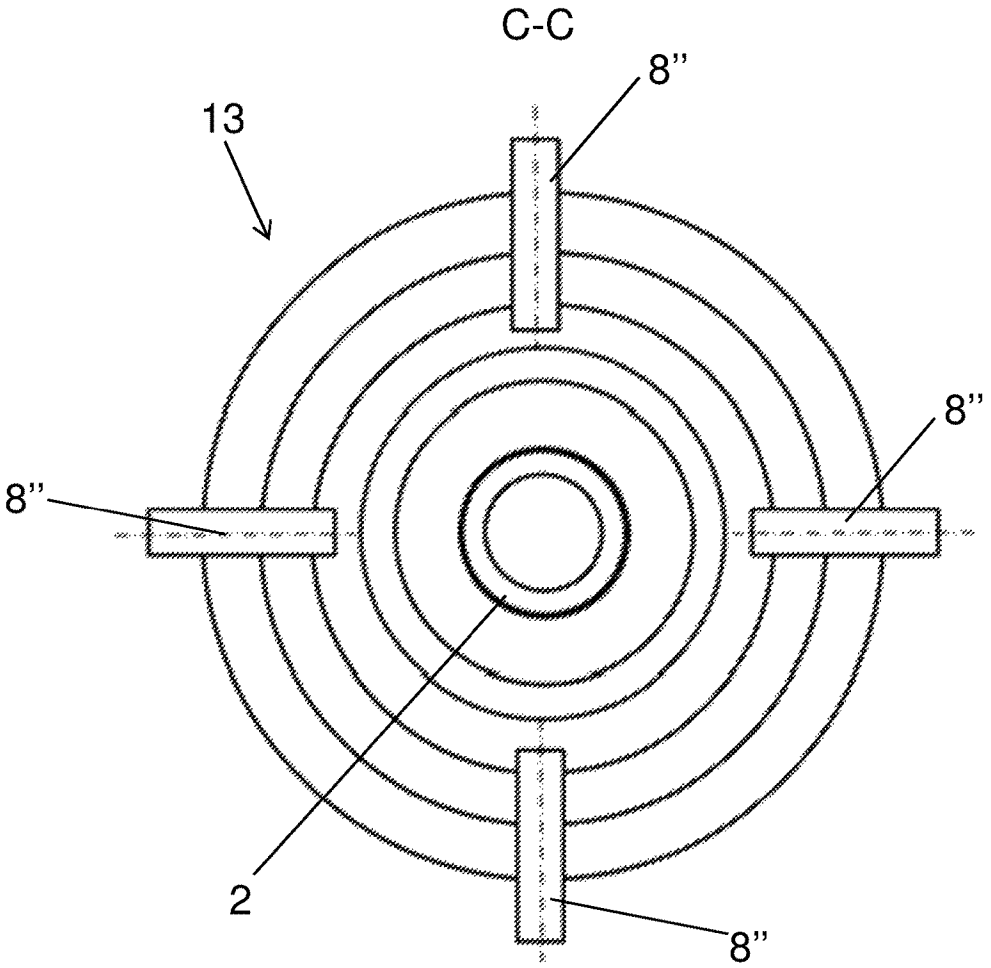

With reference to FIGS. 1 to 4, a first preferred embodiment is depicted of a drawing machine for drawing tubes, globally indicated by reference numeral 1.

Such a drawing machine, defining a longitudinal axis Y, comprises:

a first die 3, or working die, for carrying out the drawing of tube 2 by means of the use of a mandrel 4;

a device 5 for varying the inclination of the tube entering said first die 3;

a second die 6, or skin pass die, for earning out a skin pass operation on the tube, arranged downstream of said first die 3;

an in-line detection system for detecting the eccentricity of the tube;

a data processing system 7 for processing signals originating from said detection system and sending input data to said device 5 for varying the inclination of the tube to vary the inclination of the tube so as to correct the eccentricity of the tube in-line.

In a first advantageous variant of the invention, the in-line system for detecting the eccentricity of the tube comprises a first detection bead provided with at least three transducers 8, preferably four transducers, arranged in the die holder 6' of the second die 6. Providing these transducers in the structure of the skin pass die and not in the structure of the working die allows increased duration of the useful life of the transducers. Indeed, the second die 6 only carries out a passage on the outer surface of the tube (skin pass) to ensure contact with, the tube itself of which the thickness is to be measured. Therefore, the second die 6 will undergo heating which, although at high levels, is significantly lower than the one undergone by the first die 3.

In addition, a further advantage is that the in-line eccentricity detection system comprises a second detection head 9, arranged downstream of said second die 6, also provided with at least three second transducers 8', preferably but not necessarily four in number. This second detection head allows the eccentricity obtained to be measured and checked, thus ensuring the system is correcting and not creating further eccentricity. Said second detection head 9 is provided preferably downstream of a caterpillar 10 on which both the first die 3 and the second die 6 are arranged.

The transducers 8, 8' are preferably of the ultrasonic type and are arranged angularly equidistant from each other. Other types of transducers can in any case be used.

The number of transducers in each detection head can also be greater than, four, for example equal to six or eight. The greater the number of transducers, the more accurate the measurement of the eccentricity, hence the sensitivity of the device 5 for varying the inclination of the tube should be designed so as to maximize the accuracy of the eccentricity measurement.

Advantageously, one end of the transducers 8, which are inserted in the die holder 6', is in contact with a first channel 11, which is preferably coaxial to the longitudinal axis Y, provided in the die holder 6' for the passage of a coupling medium, preferably oil, for example the same oil used during the drawing. There is a need to interpose a suitable layer of solid, liquid or viscous substance (coupling medium) between each transducer and the tube to be tested to avoid air between the transducer and tube. As air has a very low acoustic impedance, it has very high reflection coefficient values, thus not allowing an appropriate passage for the ultrasonic wave from the radiant surface of the transducer to the tube material. Channel 11, preferably annular in shape, has an inlet conduit 11' and an outlet conduit 11". Advantageously, the configuration, of such conduits 11', 11" is such that the supply of the oil is carried out from the bottom upwards. Therefore, in a variant, the conduits 11' and 11" are arranged along a same axis, which is preferably but not necessarily vertical. Furthermore, the motion of the oil is to be laminar because any swirls could create the presence of undesired air bubbles.

A further increased duration of the transducers 8 is also obtained by providing a second channel 12, which is preferably coaxial to the longitudinal axis Y, inside the die holder 6', for the passage of a cooling fluid close to said transducers 8. Such a second channel 12, for the passage for example of cooling water, allows, together with the oil passing in channel 11, an increased heat dispersion, the heat being generated by the drawing and the skin pass operation.

A chamber 13 is provided, coaxial to the longitudinal axis Y, between the first die 3 and the second die 6.

In a second advantageous variant of the invention, alternative to the first variant, the aforesaid first detection head can be provided in chamber 13, arranged between the die holder 3' and the die holder 6', and comprises at least three transducers 8", preferably of the ultrasonic type and angularly equidistant from each other. Also in this case, the number of the transducers 8" is preferably four or greater than four. The structure of chamber 13 provides a channel 23 for the passage of a coupling medium, preferably drawing oil, in contact with the ends of the transducers 8" and with lute 2 itself. This detection head detects the eccentricity of tube 2 immediately after the drawing in the first die 3 and before the skin pass operation in the second die 6. Performing the measurement in this chamber between working die and skin pass die allows obtaining a more precise measurement because the tube does not move, at the chamber 13, in transverse direction with respect to axis Y, whereby the transducers 8" can be positioned closer to tube 2. Furthermore, the ultrasonic sound is not to cross different materials such as those of which the dies are made, as it has only oil between itself and tube 2 to be measured. Finally, the increased quantity of oil and the non-direct contact of the transducer with the hot die for the deformation machining makes such an area better for protecting the transducers from overheating.

A third advantageous variant of the invention, alternative to the first and to the second variant, instead provides the presence of two first detection heads: one provided in chamber 13, arranged between the die holder 3' and the die holder 6', and comprising at least three, transducers 8", as described for the second variant; the other provided in the die holder 6' of the second die 6 and provided with at least three transducers 8, as described for the first variant.

Figure 3B:
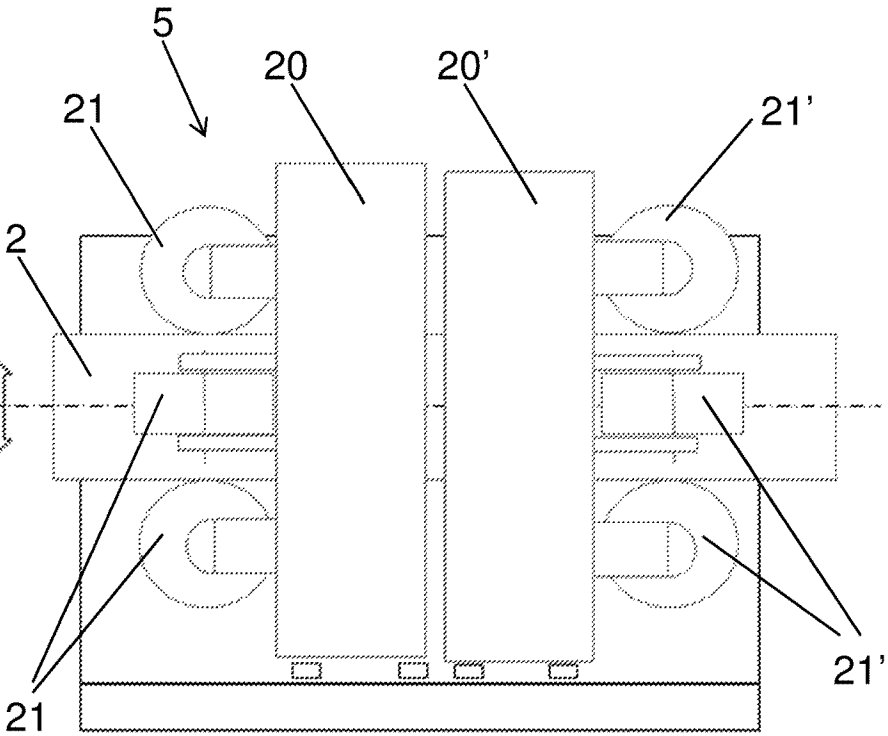
FIGS. 3*a* and 3*b* show schematic side views of a second part of the machine in FIG. 1.
Figure 3A:
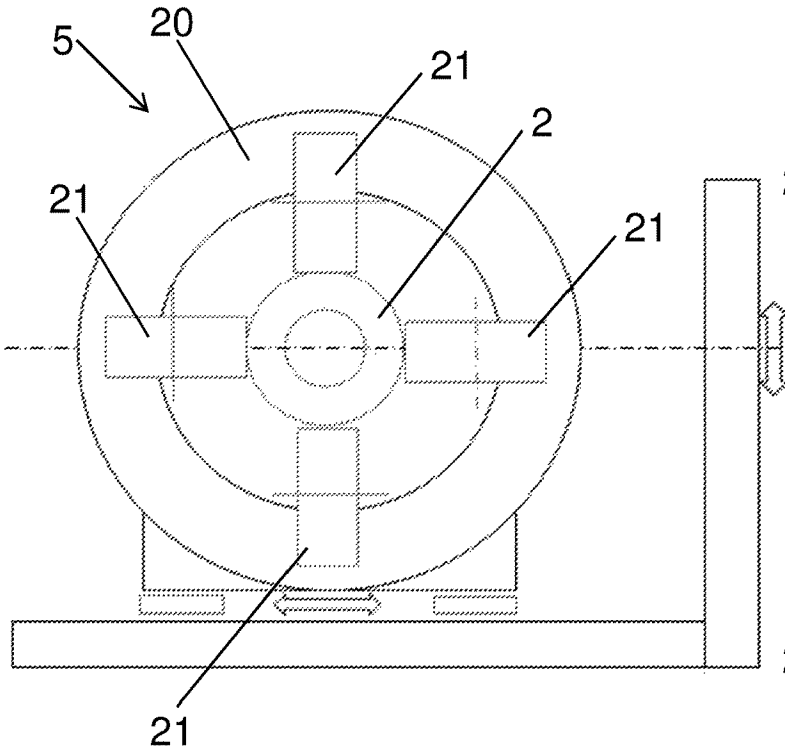
Figure 4:
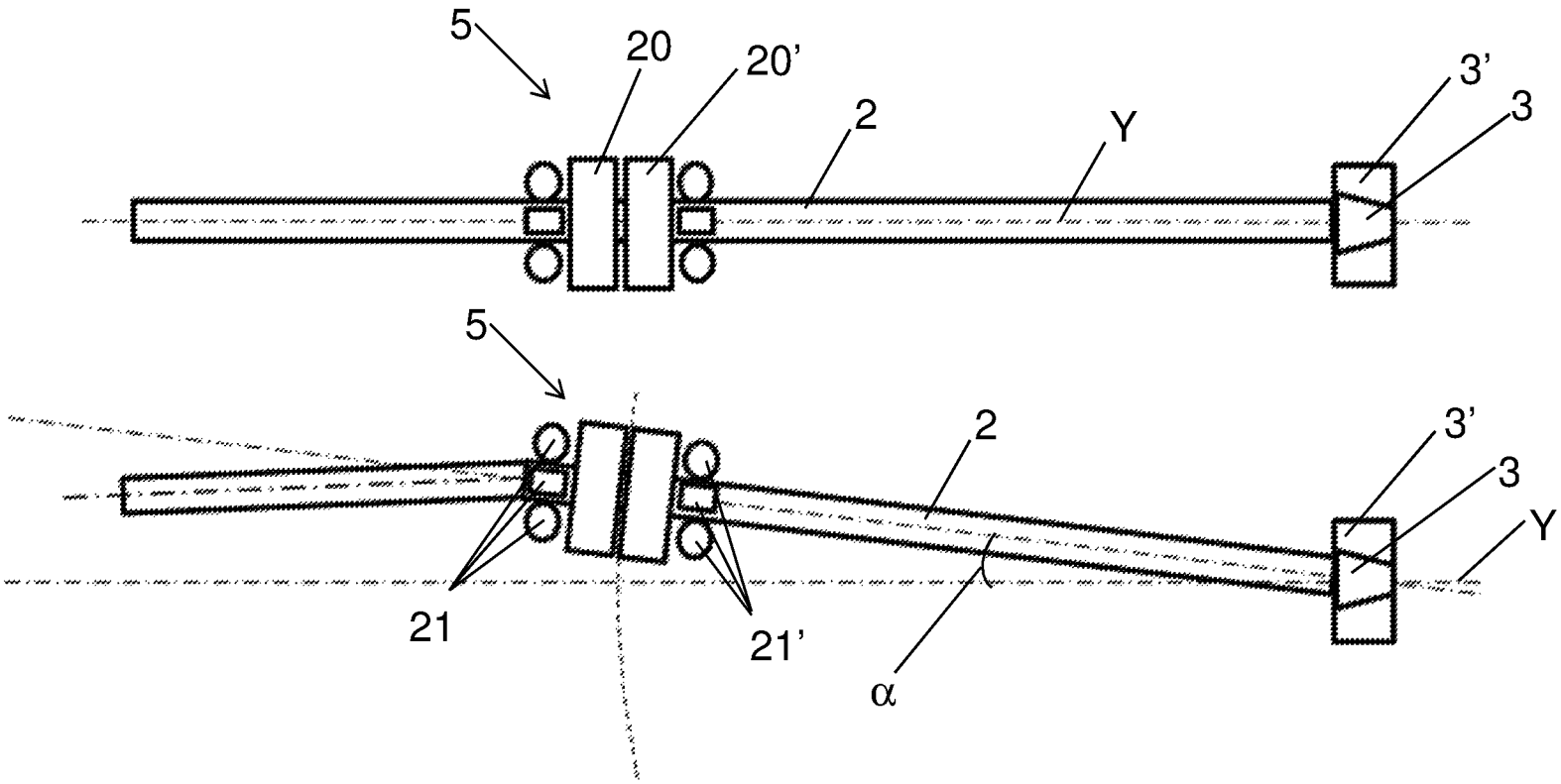
FIG. 4 shows a schematic view of the operating mode of certain parts of the machine of the invention.

The inclination variation device 5 comprises, in each of the three variants described above, two self-centering gripper heads 20, 20', each gripper head being provided with at least three rollers 21, 21'. FIGS. 3*a* and 3*b* show a preferred, variant with the gripper heads 20, 20' having four rollers 21, 21', arranged at 90° from each other. The rollers 21, 21' are shaped in suitable manner so that there are no edges pushing tube 2 but it is always held and pushed on the largest part possible of its outer surface. In this variant, die four rollers 21 of the gripper head 20 are aligned at the corresponding four rollers 21' of the gripper head 20'. In an alternative variant, the rollers 21 of the first gripper head can be offset by 45° with respect to the rollers 21' of the second gripper head.

In one variant of the present invention, device 5 moves along arcs of circles with center in the working die 3, as shown in FIG. 4*b*.

In a second variant (not illustrated), device 5 instead moves linearly along a direction orthogonal to the longitudinal axis Y.

Device 5 is positioned at approximately 1000-2000 mm from the first die 3 of caterpillar 10 and the maximum bending angle $\alpha$ of the tube is approximately 7-8° with respect to axis Y.

The movement of the roller units 21, 21' is hydraulic with servo valves assembled directly on respective cylinders (not illustrated).

Described below is an in-line method for correcting the eccentricity of a tube 2 during the drawing thereof, by means of the use of the aforesaid drawing machine. The method comprises the following stages:

drawing tube 2 by means of the first die 3 provided with mandrel 4;

carrying out a skin pass operation on tube 2 by means of the second die 6;

detecting the eccentricity of tube 2 in-line, downstream of said first die 3 by means of the first detection head provided with transducers 8;

processing the signals originating from said first detection head by means of the data processing system 7 and sending input data to the device for varying the inclination 5 of the tube so as to vary the inclination of the tube with respect to the longitudinal axis Y and to correct the eccentricity of the tube in line.

The in-line detection of the eccentricity of tube 2 is provided at said second die 6 and/or at chamber 13 arranged downstream of the first die 3 and upstream of the second die 6. In order to improve the accuracy in adjusting the eccentricity to the desired value, there can be provided one other in-line detection stage of the eccentricity of tube 2 by means of the further detection head 9 arranged downstream of the second die 6. The signals originating from said second detection head are processed by the data processing system 7 and further input data are sent to the device for varying the inclination 5 of the tube.

It is also possible to provide a combination of the machine and process features of the various variants described above.

The invention claimed is:

1. A drawing machine for drawing a tube, defining a longitudinal axis, comprising:

a first die for carrying out a drawing of the tube by means of a mandrel;

an inclination variation device for varying the inclination of the tube entering into said first die;

an in-line detection system for detecting an eccentricity of the tube;

a data processing system for processing signals originating from said in-line detection system and sending input data to said inclination variation device to vary the inclination of the tube so as to correct the concentricity of the tube in-line;

characterized in that there is provided a second die for carrying out a skin pass operation on the tube, which is arranged downstream of said first die, and in that said in-line detection system comprises a first detection head arranged downstream of said first die and comprising at least three first transducers.

2. A drawing machine according to claim 1, wherein said first detection head is arranged in a die holder of said second die.

3. A drawing machine according to claim 2, wherein said in-line detection system further comprises another first detection head arranged downstream of said first die and comprising at least three first transducers, said another first detection head arranged in a chamber, coaxial to the longitudinal axis, provided between a die holder of said first die and the die holder of said second die.

4. A drawing machine according to claim 1, wherein said in-line detection system comprises a second detection head, arranged downstream of said second die, comprising at least three second transducers.

5. A drawing machine according to claim 4, wherein said second detection head is provided downstream of a caterpillar on which said first die and said second die are arranged.

6. A drawing machine according to claim 4, wherein said second transducers are of the ultrasonic type and are angularly equidistant from each other.

7. A drawing machine according to claim 1, wherein said first transducers are of the ultrasonic type and are angularly equidistant from each other.

8. A drawing machine according to claim 1, wherein one end of said first transducers is in contact with a first channel, which is coaxial to the longitudinal axis and is provided in a die holder of said second die, for the passage of a coupling medium.

9. A drawing machine according to claim 8, wherein there is provided a second channel, which is coaxial to the longitudinal axis and is made in the die holder of said second die, for the passage of a cooling fluid next to said first transducers.

10. A drawing machine according to claim 8, wherein the coupling medium is oil.

11. A drawing machine according to claim 1, wherein said inclination variation device comprises two self-centering gripper heads, each gripper head having four rollers arranged at 90° from each other.

12. A drawing machine according to claim 1, wherein said first detection head is arranged in a chamber, coaxial to the longitudinal axis, provided between a die holder of said first die and the die holder of said second die.

13. An in-line method for correcting an eccentricity of a tube during a drawing thereof, by means of a drawing machine according to claim 1, the method comprising the following stages:

drawing the tube by means of the first die;

carrying out a skin pass operation on the tube by means of the second die;

carrying out a first in-line detection of the eccentricity of the tube by means of the first detection head;

processing signals originating from said first detection head by means of the data processing system and sending input data to the inclination variation device so as to vary the inclination of the tube with respect to the longitudinal axis and to correct the eccentricity of the tube in-line.

14. An in-line method according to claim 13, wherein there is provided a second in-line detection of the eccentricity of the tube by means of a second detection head arranged downstream of said second die, the method further comprising processing signals originating from said second detection head by means of the data processing system and sending further input data to the inclination variation device.

15. An in-line method according to claim 13, wherein said first in-line detection of the eccentricity of the tube is provided at said second die.

16. An in-line method according to claim 15, wherein there is provided a second in-line detection of the eccentricity of the tube by means of a second detection head arranged downstream of said second die, the method further comprising processing signals originating from said second detection head by means of the data processing system and sending further input data to the inclination variation device.

17. An in-line method according to claim 15, wherein said first in-line detection of the eccentricity of the tube is further provided at an area arranged downstream of said first die and upstream of said second die.

18. An in-line method according to claim 17, wherein there is provided a second in-line detection of the eccentricity of the tube by means of a second detection head arranged downstream of said second die, the method further comprising processing signals originating from said second detection head by means of the data processing system and sending further input data to the inclination variation device.

19. An in-line method according to claim 13, wherein said first in-line detection of the eccentricity of the tube is provided at an area arranged downstream of said first die and upstream of said second die.

20. An in-line method according to claim 19, wherein there is provided a second in-line detection of the eccentricity of the tube by means of a second detection head arranged downstream of said second die, the method further comprising processing signals originating from said second detection head by means of the data processing system and sending further input data to the inclination variation device.

* * * * *